US008522966B1

(12) United States Patent
Siebel

(10) Patent No.: US 8,522,966 B1
(45) Date of Patent: Sep. 3, 2013

(54) BEVERAGE CARRYING ASSEMBLY

(76) Inventor: Rohan M. Siebel, Camberwell (AU)

( * ) Notice: Subject to any disclaimer, the term of this patent is extended or adjusted under 35 U.S.C. 154(b) by 0 days.

(21) Appl. No.: 13/370,290

(22) Filed: Feb. 9, 2012

(51) Int. Cl.
*B65D 71/12* (2006.01)
*B65D 5/00* (2006.01)

(52) U.S. Cl.
USPC ..... 206/144; 206/141; 206/175; 206/427; 229/915

(58) Field of Classification Search
USPC ..... 206/141, 144, 147, 193–198, 1, 427, 206/525.1, 806, 174, 175, 509–510; 229/904, 229/932, 117.14, 915
See application file for complete search history.

(56) References Cited

U.S. PATENT DOCUMENTS 2,023,852 A 12/1935 Oser et al.
2,362,990 A * 11/1944 Crane ..... 206/171
2,513,762 A 7/1950 Tyson, Jr.
4,196,807 A 4/1980 Brom
D367,409 S 2/1996 Hunter
5,520,284 A * 5/1996 Gray ..... 206/509
5,624,024 A 4/1997 Miess
5,743,389 A 4/1998 Cutler et al.
2008/0087558 A1* 4/2008 Libit et al. ..... 206/196
2010/0059392 A1* 3/2010 Weinberger ..... 206/151

* cited by examiner

*Primary Examiner* — J. Gregory Pickett
*Assistant Examiner* — Mollie Llewellyn

(57) ABSTRACT

A beverage carrying assembly includes a panel that has a top side, a bottom side and a perimeter edge. The perimeter edge includes a first lateral edge, a second lateral edge, a front edge and a rear edge. The panel has a pair of major bend lines each extending from the front edge to the rear edge. Each of the major bend lines defines a first portion, a second portion and a middle portion wherein the middle portion includes openings for receiving beverage cups. The first and second portions each include grooves and insertion tabs for allowing multiple ones of the panels to be secured together in stacked configuration for holding several beverage cups.

7 Claims, 5 Drawing Sheets

BEVERAGE CARRYING ASSEMBLY

BACKGROUND OF THE DISCLOSURE

Field of the Disclosure

The disclosure relates to beverage carrying devices and more particularly pertains to a new beverage carrying device for carrying multiple beverages.

SUMMARY OF THE DISCLOSURE

An embodiment of the disclosure meets the needs presented above by generally comprising a panel that has a top side, a bottom side and a perimeter edge. The perimeter edge includes a first lateral edge, a second lateral edge, a front edge and a rear edge. The panel has a pair of major bend lines each extending from the front edge to the rear edge. Each of the major bend lines defines a first portion, a second portion and a middle portion of the panel. Each of the first and second portions is positionable to define a carrying position so the panel is bent at each of the major bend lines such that each of the first and second portions are directed upwardly from the middle portion. The panel is comprised of a bendable material. The first portion includes a handle cutout extending therethrough. The second portion includes a handle aperture extending therethrough. Each of the first and second portions has a pair of grooves each extending inwardly from a corresponding one of the front and rear edges. Each pair of the grooves is positioned nearer to a corresponding one of the first and second lateral edges than a corresponding one of the major bend lines. Each of the grooves defines an insertion tab positioned between the corresponding ones of the grooves and the first and second lateral edges. Each of the first and second portions has a pair of tab cutouts extending therethrough. Each of the tab cutouts extends from the top side to the bottom side. Each of the tab cutouts insertably receives an insertion tab from another one of the assemblies. The middle portion includes a plurality of cup apertures extending therethrough. Each of the cup apertures extends through the top and bottom sides. Each of the cup apertures has a circular shape and insertably receives a beverage cup. The first and second portions are positioned in the carrying position and directed toward each other so the top sides of each of the first and second portions abut adjacent to each of the first and second lateral edges.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
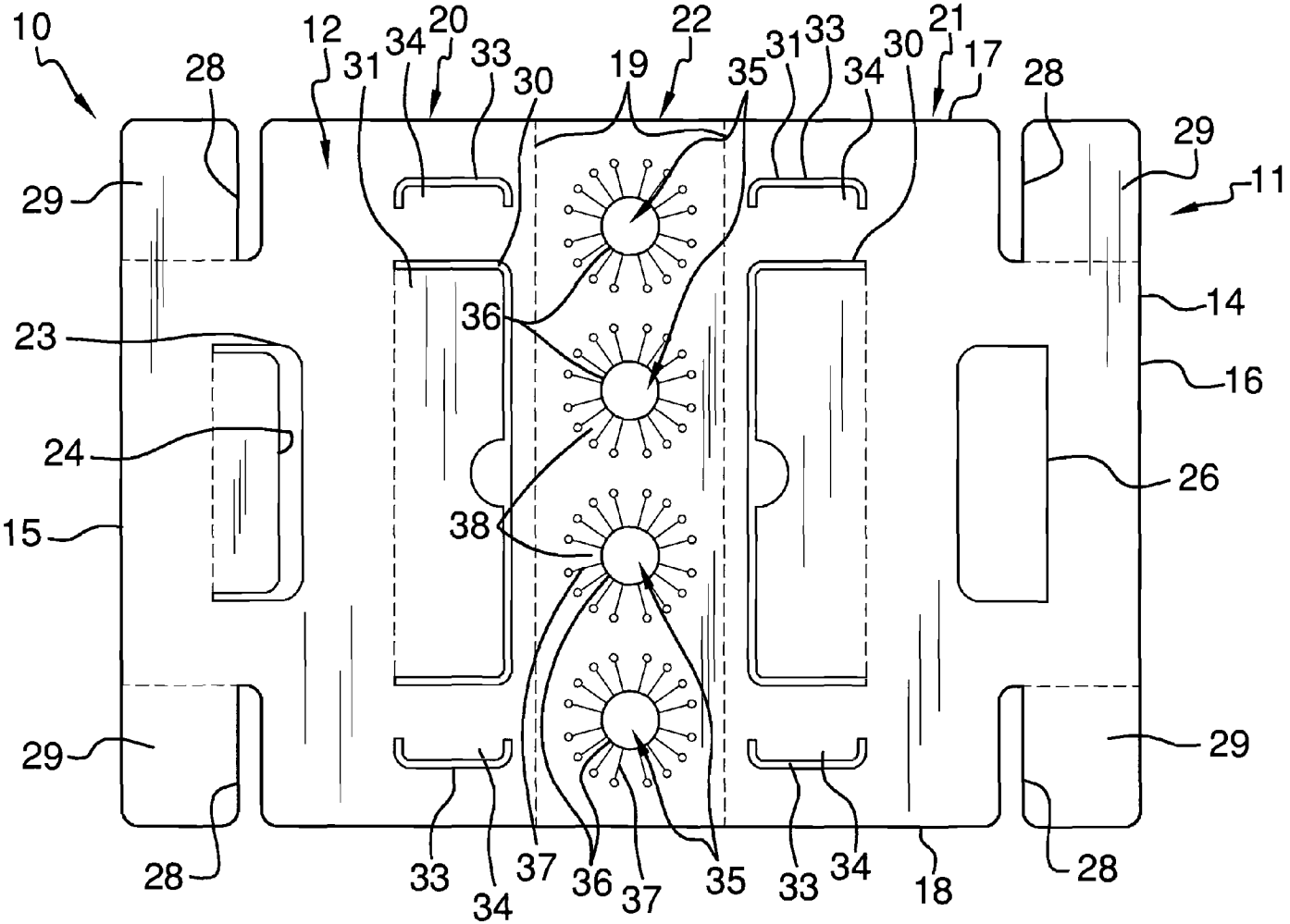
FIG. 1 is a top side view of a beverage carrying assembly according to an embodiment of the disclosure.
Figure 2:
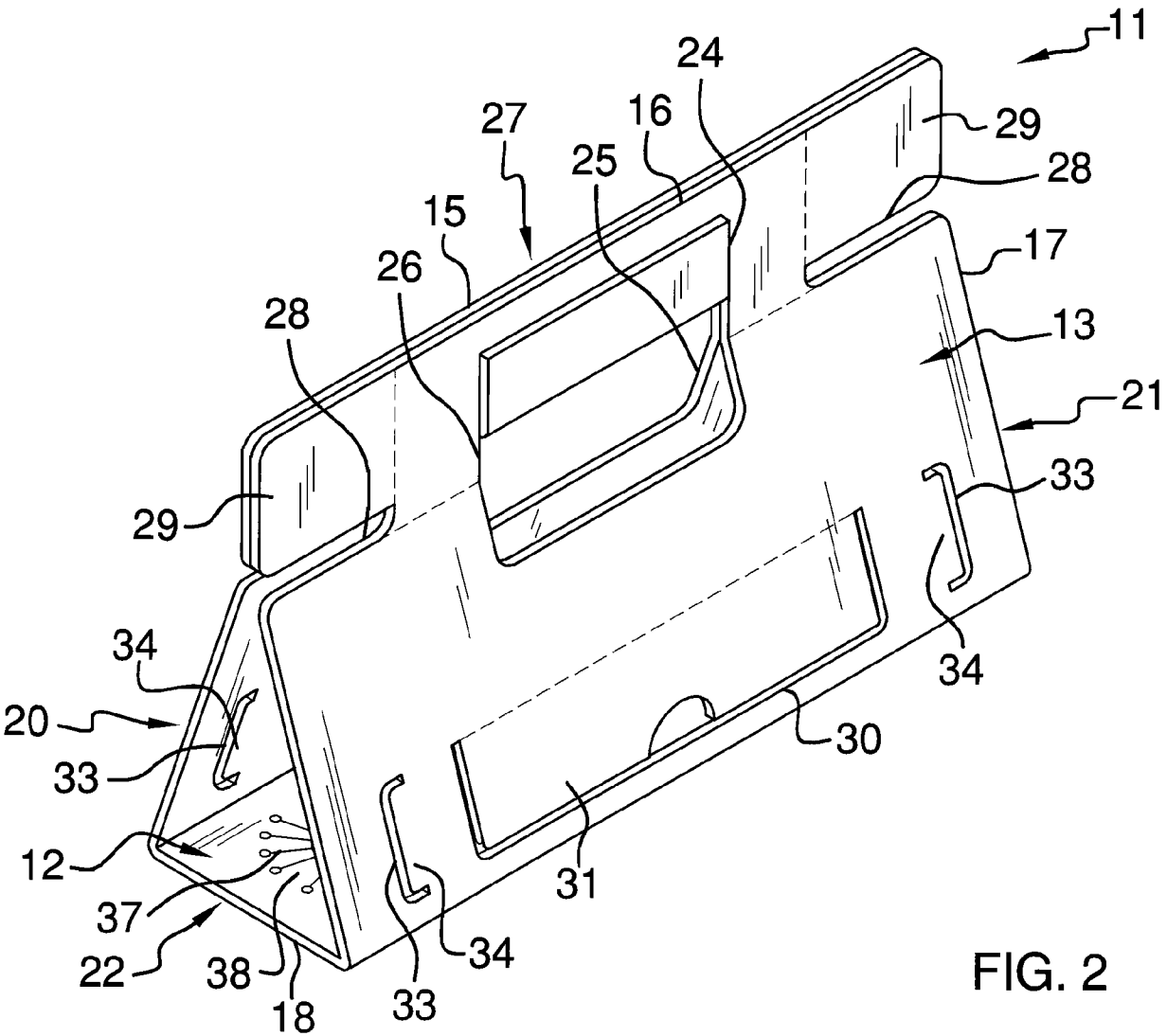
FIG. 2 is a right side perspective view of an embodiment of the disclosure.

With reference now to the drawings, and in particular to FIGS. 1 through 6 thereof, a new beverage carrying device embodying the principles and concepts of an embodiment of the disclosure and generally designated by the reference numeral 10 will be described.

As best illustrated in FIGS. 1 through 6, the beverage carrying assembly 10 generally comprises a panel 11 that has a top side 12, a bottom side 13 and a perimeter edge 14. The perimeter edge 14 includes a first lateral edge 15, a second lateral edge 16, a front edge 17 and a rear edge 18. The panel 11 has a pair of major bend lines 19 each extending from the front edge 17 to the rear edge 18. Each of the major bend lines 19 defines a first portion 20, a second portion 21 and a middle portion 22 of the panel 11.

Each of the first 20 and second 21 portions is positionable to define a carrying position. The panel 11 may be bent at each of the major bend lines 19 to define the carrying position. Each of the first 20 and second 21 portions may be directed upwardly from the middle portion 22 after the panel 21 is bent. The panel 11 may be comprised of a bendable material such as cardboard or other similar material.

The first portion 20 includes a handle cutout 23 extending therethrough. The handle cutout 23 extends through the top 12 and bottom sides 13. The handle cutout 23 has a U-shape defining a bendable handle tab 24. The handle tab 24 is outwardly bendable to form a handle opening 25.

The second portion 21 includes a handle aperture 26 extending therethrough. The handle aperture 26 extends from the top side 12 to the bottom side 13. The handle aperture 26 may removably receive the handle tab 24. When the handle tab 24 is inserted through the handle aperture 26 the handle aperture 26 and the handle opening 25 form a handle 27.

Each of the first 20 and second 21 portions has a pair of grooves 28 each extending inwardly from a corresponding one of the front 17 and rear 18 edges. Each pair of the grooves 28 is positioned nearer to a corresponding one of the first 15 and second 16 lateral edges than a corresponding one of the major bend lines 19. Each of the grooves 28 defines a bendable insertion tab 29 positioned between the corresponding ones of the grooves 28 and the first 15 and second 16 lateral edges.

Each of the first 20 and second 21 portions has an attaching cutout 30 extending therethrough. The attaching cutout 30 extends through the top side 12 and the bottom side 13. The attaching cutout 30 has a U-shape defining an attaching tab 31. The attaching tab 31 is outwardly bendable to form an attaching opening 32 to receive a first lateral edge 15 or a second lateral edge 16 of another one of the assemblies 10.

Each of the first 20 and second 21 portions has a pair of tab cutouts 33 extending therethrough. Each of the tab cutouts 33 extends from the top side 12 to the bottom side 13. Each of the tab cutouts 33 defines a bendable cut out tab 34. Each of the tab cutouts 33 may insertably receive an insertion tab 29 from the other one of the assemblies 10.

The middle portion 22 includes a plurality of cup apertures 35 extending therethrough. Each of the cup apertures 35 extends through the top 12 and bottom 13 sides. Each of the cup apertures 35 has a circular shape and may insertably receive a beverage cup 40. The cup apertures 35 are aligned with each other along an axis extending through the front 17 and rear 18 edges. The plurality of cup apertures 35 includes at least three cup apertures 35.

Each of the cup apertures 35 is defined by a peripheral edge 36. Each peripheral edge 36 has a plurality of cuts 37 extending outwardly from the peripheral edge 36 to form expansion tabs 38 between each of the adjacent cuts 37. Each of the expansion tabs 38 may abut an outer surface 39 of the inserted beverage cups 40. The expansion tabs 38 may be bent downwardly to selectively increase a diameter of the cup apertures 35 to match a diameter of the beverage cups 40. The expansion tabs 38 may increase the diameter of the cup apertures 35 to a diameter that is less than the maximum diameter of the beverage cups 40.

After the beverage cups 40 are inserted into the cup apertures 35 the first 20 and second 21 portions may be positioned in the carrying position. The first 20 and second 21 portions may be directed toward each other. The first 20 and second 21 portions may be bent near the grooves 28 so the top sides 12 of each of the first 20 and second 21 portions abut adjacent to each of the first 15 and second 16 lateral edges. The handle tab 24 may be extended through the handle aperture 26 and bent upwardly to abut the bottom side 13 of the second portion 21 to retain each of the first 20 and second 21 portions in the carrying position and to form the handle 27.

Figure 4:
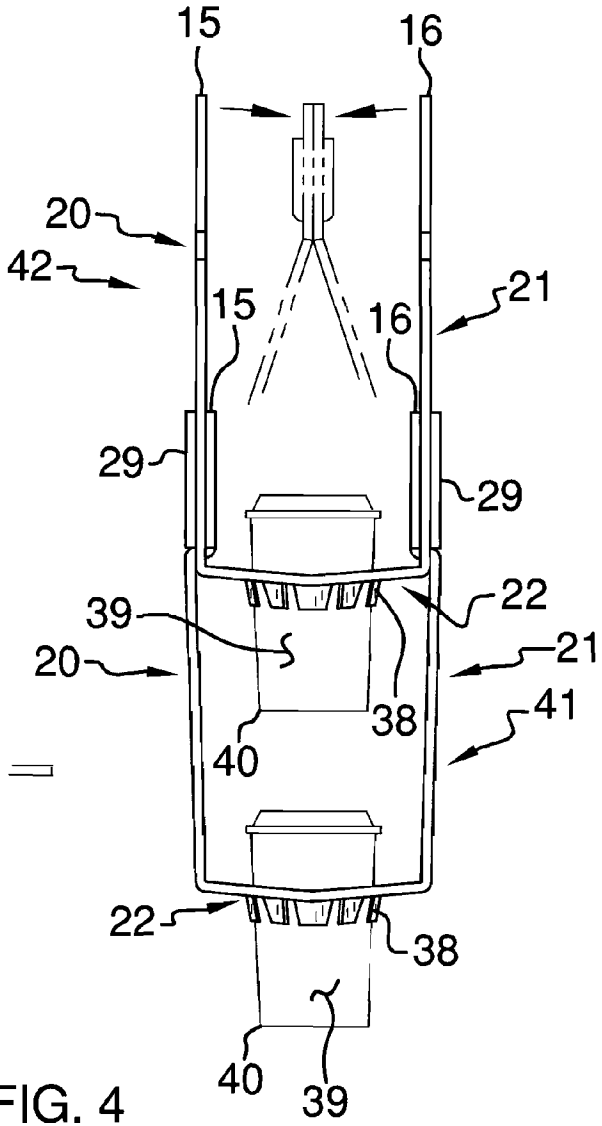
FIG. 4 is a rear side view of an embodiment of the disclosure.
Figure 3:
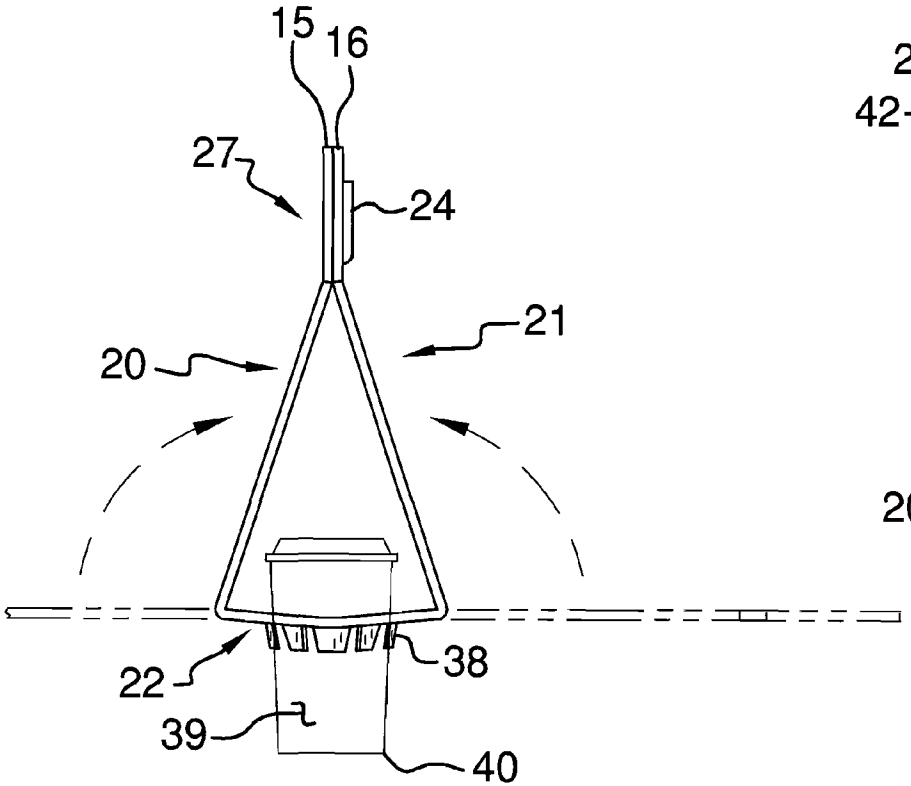
FIG. 3 is a rear side view of an embodiment of the disclosure.
Figure 5:
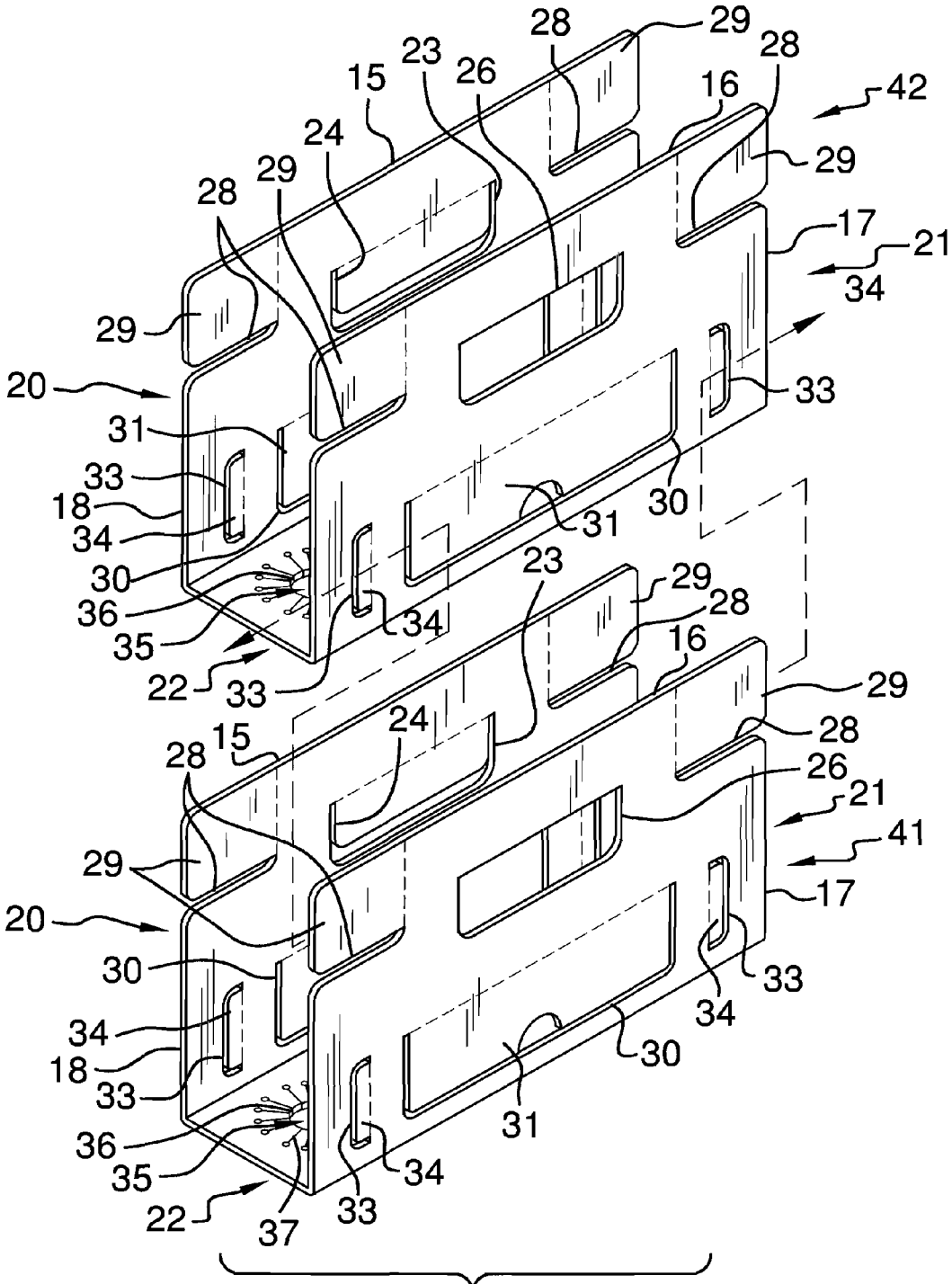
FIG. 5 is a perspective view of an embodiment of the disclosure.
Figure 6:
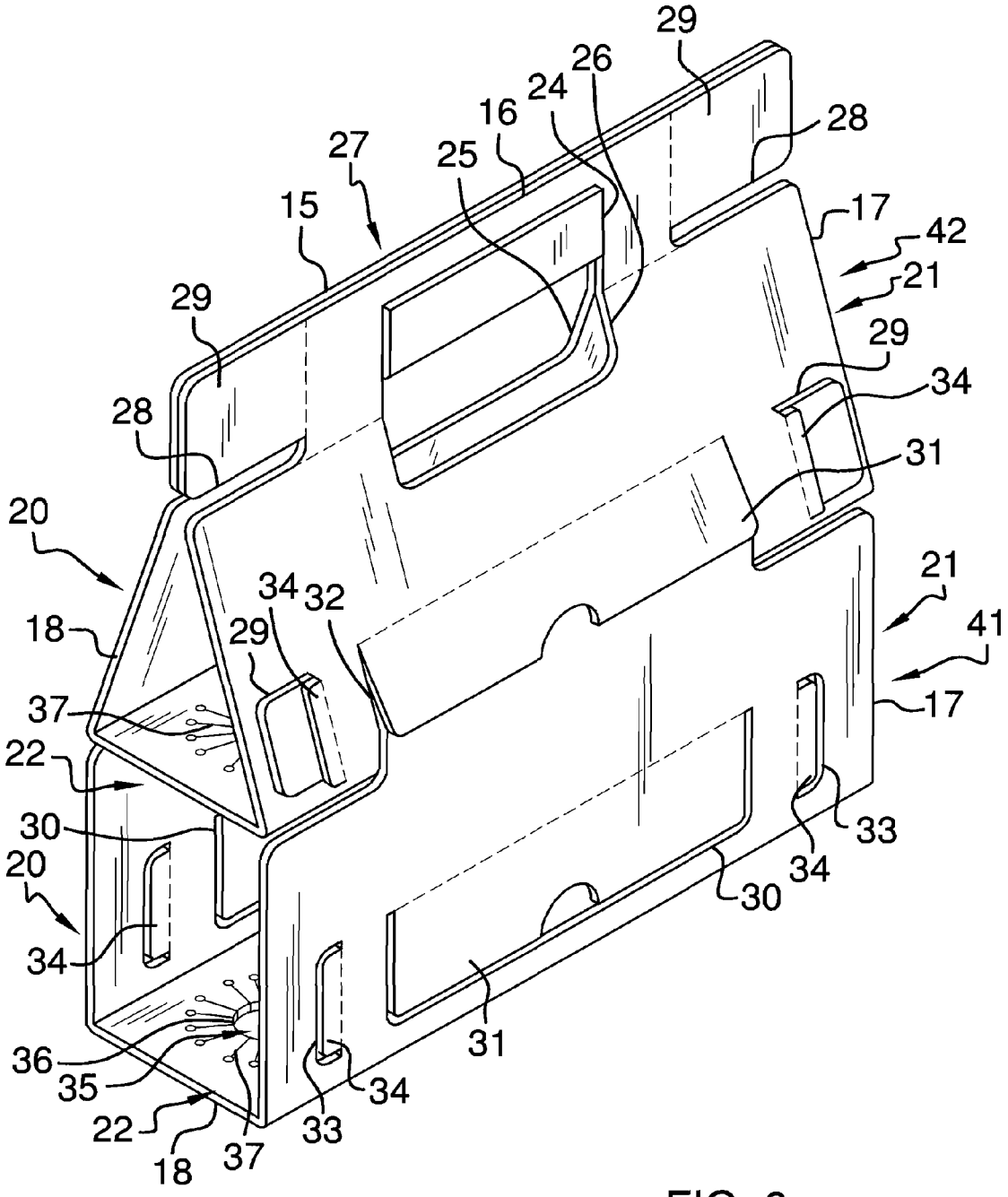
FIG. 6 is a right side perspective view of an embodiment of the disclosure.

As illustrated in FIGS. 4-6, generally, a pair of assemblies 10 may be vertically stacked. Each of the first 20 and second portions 21 on a bottom assembly 41 may be positioned to define the carrying position. Each of the insertion tabs 29 on the bottom assembly 41 may be bent inwardly so each of the insertion tabs 29 abuts the top side 12 of the first 20 and second 21 portions. Each of the first 20 and second 21 portions of a top assembly 42 may be positioned to define the carrying position. Each of the attaching tabs 31 on the top assembly 42 may be outwardly bent to form the attaching openings 32.

Each of the first 15 and second 16 lateral edges of the bottom assembly 41 may be extended through the attaching opening 32 of the top assembly 42. Each of the bent insertion tabs 29 on the bottom assembly 41 may be straightened out and extended through a corresponding one of the tab cutouts 33 on the top assembly 42. The first 20 and second 21 portions of the top assembly 42 may be bent near the grooves 28. The top sides 12 of each of the first 20 and second 21 portions of the top assembly 42 may abut adjacent to each of the first 15 and second 16 lateral edges of the top assembly 42. The handle tab 24 on the top assembly 42 may be inserted through the handle aperture 26 on the top assembly 42 to form the handle 27.

In use, the panel 11 is bent along each of the major bend lines 19 to position each of the first 20 and second 21 portions in the carrying position. Beverage cups 40 are inserted into each of the cup apertures 35. Each of the first 20 and second 21 portions are directed toward each other and the top sides 12 of each of the first 20 and second 21 portions are abutted adjacent to the first 15 and second 16 lateral edges of each of the first 20 and second 21 portions. The handle tab 24 is extended through the handle aperture 26 to form the handle 27.

A pair of assemblies 10, or more, may also be vertically stacked as shown in FIG. 6. Each of the first 20 and second portions 21 on a bottom assembly 41 may be positioned to define the carrying position. Each of the insertion tabs 29 on the bottom assembly 41 may be bent inwardly so each of the insertion tabs 29 abuts the top side 12 of the first 20 and second 21 portions. Each of the first 20 and second 21 portions of a top assembly 42 are positioned to define the carrying position. Each of the attaching tabs 31 on the top assembly 42 is outwardly bent to form the attaching openings 32. Each of the first 15 and second 16 lateral edges of the bottom assembly 41 are extended through the attaching opening 32 of the top assembly 42. Each of the bent insertion tabs 29 on the bottom assembly 41 are straightened out and extended through a corresponding one of the tab cutouts 33 on the top assembly 42. The first 20 and second 21 portions of the top assembly 42 are then bent near the grooves 28. The top sides 12 of each of the first 20 and second 21 portions of the top assembly 42 abut adjacent to each of the first 15 and second 16 lateral edges of the top assembly 42. The handle tab 24 on the top assembly 42 is inserted through the handle aperture 26 on the top assembly 42 to form the handle 27. The joined top 42 and bottom 41 assemblies may be disassembled to remove the beverage cups 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A beverage carrying assembly configured for carrying multiple beverages, said assembly comprising:

a panel having a top side, a bottom side and a perimeter edge, said perimeter edge including a first lateral edge, a second lateral edge, a front edge and a rear edge, said panel having a pair of major bend lines each extending from said front edge to said rear edge, each of said major bend lines defining a first portion, a second portion and a middle portion of said panel, each of said first and second portions being positionable to define a carrying position having said panel being bent at each of said major bend lines such that each of said first and second portions are directed upwardly from said middle portion, said panel being comprised of a bendable material;

said first portion including;

a handle cutout extending therethrough;

said second portion including;

a handle aperture extending therethrough;

each of said first and second portions having a pair of grooves each extending inwardly from a corresponding one of said front and rear edges, each pair of said grooves being positioned nearer to a corresponding one of said first and second lateral edges than a corresponding one of said major bend lines, each of said grooves defining an insertion tab positioned between said corresponding ones of said grooves and said first and second lateral edges;

each of said first and second portions having a pair of tab cutouts extending therethrough, each of said tab cutouts extending from said top side to said bottom side, each of said tab cutouts being coupled to said bottom side and positioned proximate said middle portion, each of said tab cutouts being configured to insertably receive an insertion tab from another one of said assemblies wherein said assemblies are capable of being vertically stacked and carried when a user inserts a hand through said handle cutout and said handle aperture of an uppermost one of said assemblies;

said middle portion including a plurality of cup apertures extending therethrough, each of said cup apertures extending through said top and bottom sides, each of said cup apertures having a circular shape and being configured for insertably receiving a beverage cup; and wherein said first and second portions are configured to be positioned in the carrying position and directed toward each other having said top sides of each of said first and second portions abutting adjacent to each of said first and second lateral edges.

2. The assembly according to claim 1, wherein said handle cutout has a U-shape defining a handle tab, said handle tab being outwardly bendable to form a handle opening, said handle aperture extending from said top side to said bottom side and removably receiving said handle tab.

3. The assembly according to claim 1, wherein each of said first and second portions has an attaching cutout extending therethrough, said attaching cutout extending through said top side and said bottom side, said attaching cutout having a U-shape defining an attaching tab, said attaching tab being outwardly bendable to form an attaching opening configured to receive a first lateral edge or a second lateral edge of said other one of said assemblies.

4. The assembly according to claim 1, wherein said cup apertures being aligned with each other.

5. The assembly according to claim 4, wherein said plurality of cup apertures includes at least three cup apertures.

6. The assembly according to claim 4, wherein each of said cup apertures is defined by a perimeter edge, each perimeter edge having a plurality of cuts therein to form expansion tabs between adjacent ones of said cuts.

7. A beverage carrying assembly configured for carrying multiple beverages, said assembly comprising:

a panel having a top side, a bottom side and a perimeter edge, said perimeter edge including a first lateral edge, a second lateral edge, a front edge and a rear edge, said panel having a pair of major bend lines each extending from said front edge to said rear edge, each of said major bend lines defining a first portion, a second portion and a middle portion of said panel, each of said first and second portions being positionable to define a carrying position having said panel being bent at each of said major bend lines such that each of said first and second portions are directed upwardly from said middle portion, said panel being comprised of a bendable material;

said first portion including;

a handle cutout extending therethrough, said handle cutout extending through said top and bottom sides, said handle cutout having a U-shape defining a handle tab, said handle tab being outwardly bendable to form a handle opening;

said second portion including;

a handle aperture extending therethrough, said handle aperture extending from said top side to said bottom side and removably receiving said handle tab;

each of said first and second portions having a pair of grooves each extending inwardly from a corresponding one of said front and rear edges, each pair of said grooves being positioned nearer to a corresponding one of said first and second lateral edges than a corresponding one of said major bend lines, each of said grooves defining an insertion tab positioned between said corresponding ones of said grooves and said first and second lateral edges;

each of said first and second portions having an attaching cutout extending therethrough, said attaching cutout extending through said top side and said bottom side, said attaching cutout having a U-shape defining an attaching tab, said attaching tab being outwardly bendable to form an attaching opening configured to receive a first lateral edge or a second lateral edge of another one of said assemblies;

each of said first and second portions having a pair of tab cutouts extending therethrough, each of said tab cutouts extending from said top side to said bottom side, each of said tab cutouts being coupled to said bottom side and positioned proximate said middle portion, each of said tab cutouts being configured to insertably receive an insertion tab from said other one of said assemblies wherein said assemblies are capable of being vertically stacked and carried when a user inserts a hand through said handle cutout and said handle aperture of an uppermost one of said assemblies;

said middle portion including a plurality of cup apertures extending therethrough, each of said cup apertures extending through said top and bottom sides, each of said cup apertures having a circular shape and being configured for insertably receiving a beverage cup, said cup apertures being aligned with each other, said plurality of cup apertures including at least three cup apertures, each of said cup apertures being defined by a perimeter edge, each perimeter edge having a plurality of cuts therein to form expansion tabs between adjacent ones of said cuts; and wherein said first and second portions are configured to be positioned in the carrying position and directed toward each other having said top sides of each of said first and second portions abutting adjacent to each of said first and second lateral edges, whereupon said handle tab is configured to be extended through said handle aperture and bent upwardly to abut said bottom side of said second portion to retain each of said first and second portions in the carrying position.

* * * * *